US006418276B2

(12) United States Patent
Huang

(10) Patent No.: US 6,418,276 B2
(45) Date of Patent: Jul. 9, 2002

(54) METHOD AND APPARATUS FOR HEATING WATER RAPIDLY AT LOW POWER REQUIREMENT

(76) Inventor: Olivia Huang, No. 2, Alley 6, Lane 403, Sec. 3, Chung-Shan Road, Wu-Tze Hsiang, Taichung Hsien (TW)

( * ) Notice: Subject to any disclaimer, the term of this patent is extended or adjusted under 35 U.S.C. 154(b) by 0 days.

(21) Appl. No.: 09/919,032

(22) Filed: Jul. 31, 2001

(30) Foreign Application Priority Data

Aug. 3, 2000 (TW) ..... 89115602 A

(51) Int. Cl.[7] ..... F24H 1/08
(52) U.S. Cl. ..... 392/471; 392/490; 219/486
(58) Field of Search ..... 392/471, 465, 392/476, 477, 478, 485, 486, 490; 219/476, 477, 480, 483, 486

(56) References Cited

U.S. PATENT DOCUMENTS 2,511,635 A * 6/1950 Holmes ..... 219/486
4,511,790 A * 4/1985 Kozak ..... 219/483
5,866,880 A * 2/1999 Seitz et al. ..... 219/483

* cited by examiner

*Primary Examiner*—Teresa Walberg
*Assistant Examiner*—Thor Campbell
(74) *Attorney, Agent, or Firm*—Trop, Pruner & Hu, P.C.

(57) ABSTRACT

A method for heating water rapidly at low power requirement includes the steps of (1) energizing and heating a heating element of a first heating device for a first period; (2) simultaneously de-energizing the heating element of the first heating device, forcing cold water to flow from a first reservoir to a second reservoir via the first heating device such that the cold water is heated to form warm water, and energizing and heating a heating element of a second heating device for a second period; and (3) simultaneously de-energizing the heating element of the second heating device and forcing the warm water from the second reservoir into the second heating device such that the warm water is heated to form hot water.

8 Claims, 10 Drawing Sheets

METHOD AND APPARATUS FOR HEATING WATER RAPIDLY AT LOW POWER REQUIREMENT

BACKGROUND OF THE INVENTION

1. Field of the Invention

This invention relates to a water heating apparatus, and more particularly to a method and apparatus for heating water rapidly at low power requirement.

2. Description of the Related Art

A conventional household potable water dispenser normally takes about 7–15 minutes to heat tap water so as to form potable hot water, thereby resulting in an inefficient water heating process. If tap water is heated in the household potable water dispenser at a high power as in a factory, a power supply for supplying electricity to the dispenser will be overloaded, thereby resulting in the possibility of a fire. Accordingly, there is a need for heating water rapidly in a household potable water dispenser at low power requirement.

SUMMARY OF THE INVENTION

An object of this invention is to provide a method and apparatus for heating water rapidly at low power requirement, in which only one heating element is energized and heated at any time so as to eliminate unnecessary power consumption, thereby resulting in an efficient water heating process.

According to an aspect of this invention, a method for heating water rapidly at low power requirement includes the steps of:

(1) energizing and heating a heating element of a first heating device for a first period so that the temperature of the heating element of the first heating device rises to a first temperature;

(2) simultaneously de-energizing the heating element of the first heating device, operating a first pump in order to force cold water to flow from a first reservoir into a second reservoir via the first heating device so as to effect a heat exchange between the cold water and the heating element of the first heating device such that the cold water is heated to form warm water, and energizing and heating a heating element of a second heating device for a second period so that the temperature of the heating element of the second heating device rises to a second temperature that is higher than the first temperature; and (3) simultaneously de-energizing the heating element of the second heating device and operating a second pump in order to force the warm water from the second reservoir into the second heating device so as to effect a heat exchange between the warm water and the heating element of the second heating device such that the warm water is heated to form hot water. Because only one of the heating elements of the first and second heating devices is energized at any time, unnecessary power consumption is eliminated, thereby resulting in an efficient water heating process.

According to another aspect of this invention, an apparatus for heating water rapidly at low power requirement includes a first reservoir for storing cold water, and a control unit. A first heating device is connected to the control unit and the first reservoir, and includes a tubular body that defines a chamber therein, a heating element that is fixed in the chamber in the first heating device, an inlet that is formed in an end of the tubular body of the first heating device and that is in fluid communication with the chamber in the first heating device and the first reservoir, and an outlet that is formed in the other end of the tubular body of the first heating device and that is in fluid communication with the chamber in the first heating device. A second reservoir is connected to the tubular body of the first heating device, and is in fluid communication with the outlet in the first heating device. A first pump, which is connected to the control unit, forces the cold water from the first reservoir into the second reservoir via the tubular body of the first heating device so as to effect a heat exchange between the cold water and the heating element of the first heating device such that the cold water is heated to form warm water. The heating element of the first heating device is energized and heated for a first period and to a first temperature just before the cold water flows into the first heating device, under control of the control unit. A second heating device is connected to the control unit and the second reservoir, and includes a tubular body that defines a chamber therein, a heating element that is fixed in the chamber in the second heating device, an inlet that is formed in an end of the tubular body of the second heating device and that is in fluid communication with the chamber in the second heating device and the second reservoir, and an outlet that is formed in the other end of the tubular body of the second heating device and that is in fluid communication with the chamber in the second heating device. The heating element of the second heating device is de-energized when the heating element of the first heating device is energized, and vice versa, under the control of the control unit. A second pump, which is connected to the control unit, forces the warm water from the second reservoir into the second heating device so as to effect a heat exchange between the warm water and the heating element of the second heating device such that the warm water is heated to form hot water. The heating element of the second heating device is energized and heated for a second period and to a second temperature, which is higher than the first temperature, just before the warm water flows into the second heating device, under the control of the control unit.

BRIEF DESCRIPTION OF THE DRAWINGS

These and other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
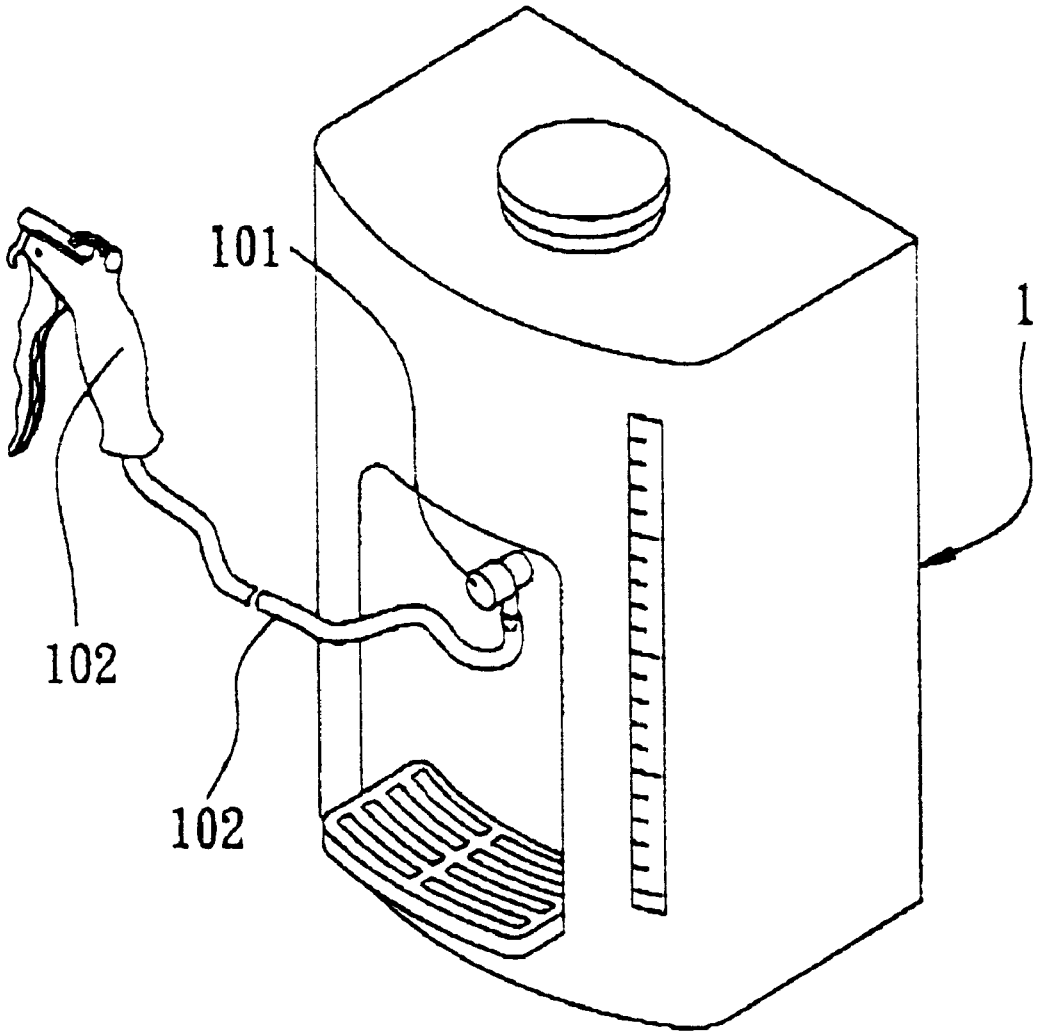
FIG. 1 is a perspective view of a first preferred embodiment of an apparatus for heating water rapidly at low power requirement according to this invention, which is constructed as a household potable water dispenser.
Figure 2:
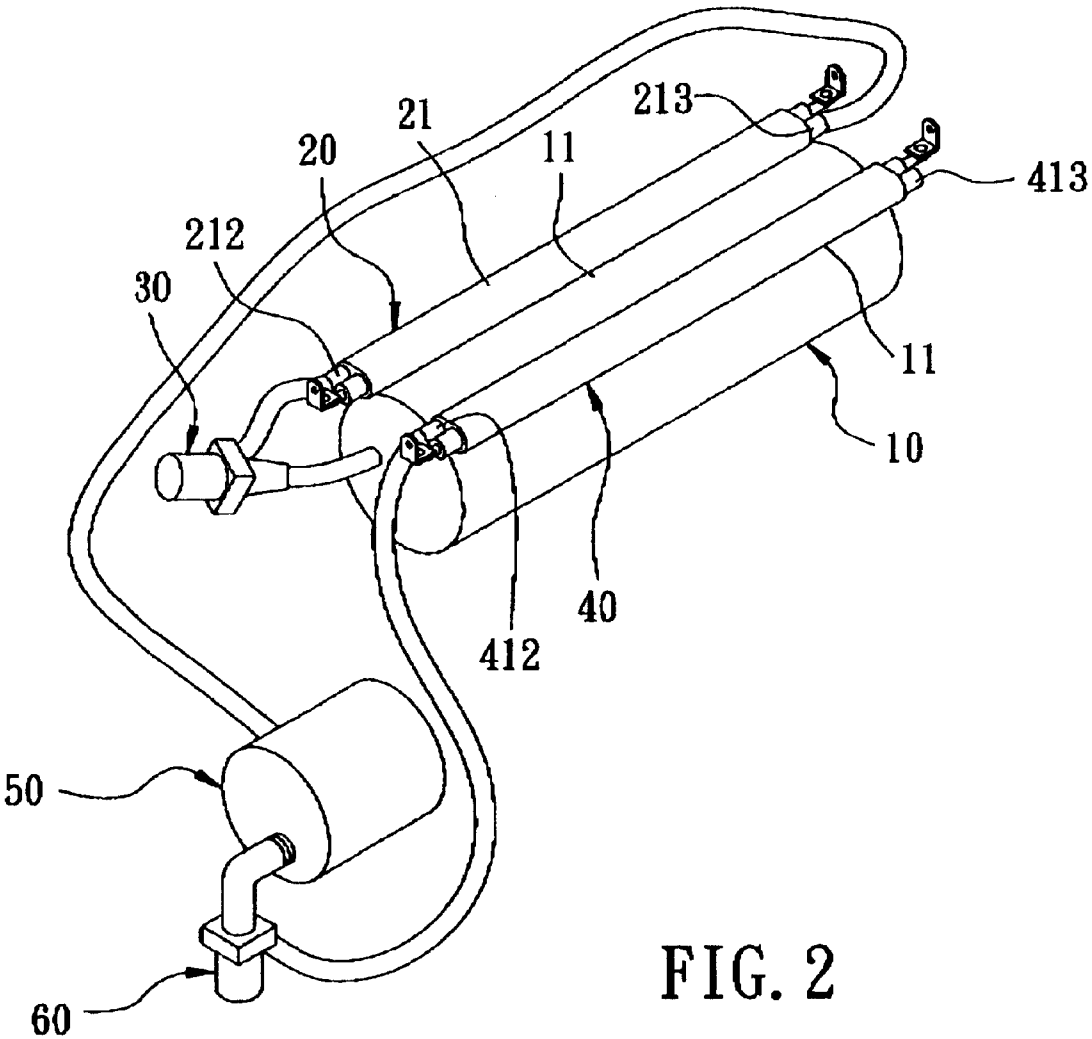
FIG. 2 is a fragmentary perspective view of the first preferred embodiment.

Before the present invention is described in greater detail in connection with the preferred embodiments, it should be noted that similar elements and structures are designated by like reference numbers throughout the entire disclosure.

Referring to FIGS. 1, 2, 3 and 4, a first preferred embodiment of an apparatus for heating water rapidly at low power requirement is constructed as a household potable water dispenser, and is shown to include a housing unit 1, a water tap unit 101 that is disposed on the housing unit 1, and a nozzle 102 that is connected to the housing unit 1 via a water duct 103. The nozzle 102 can spray hot water from the water tap unit 101 onto a door, a window, bowls or dishes for cleaning purposes. In the housing unit 1, there are provided a first reservoir 10, a first heating device 20, a first pump 30, a second heating device 40, a second reservoir 50, a second pump 60 and a control unit 100 (see FIG. 5).

The first reservoir 10 stores cold water, i.e. tap water, which has a temperature of about 22° C.~25° C.

Each of the first and second heating devices 20, 40 includes a tubular body 21, 41 that defines a chamber 214, 414 therein, a heating element 211, 411 that is fixed in the chamber 214, 414, an inlet 212, 412 that is formed in an end of the tubular body 21, 41 and that is in fluid communication with the chamber 214, 414, and an outlet 213, 413 that is formed in the other end of the tubular body 21, 41 and that is in fluid communication with the chamber 214, 414. The tubular body 21, 41 of each of the first and second heating devices 20, 40 is horizontal, and has an elliptical cross-section, a first end wall 21A, 41A and a second end wall 21B, 41B.

In each of the first and second heating devices 20, 40, the heating element 211, 411 is elongated and inclined, and extends through a right portion of the first end wall 21A, 41A and a left portion of the second end wall 21B, 41B. The inlets 212, 412 are formed at left portions of the first end walls 21A, 41A, whereas the outlets 213, 413 are formed at right portions of the second end walls 21B, 41B. Accordingly, heat can be transmitted evenly from the heating elements 211, 411 to water flowing from the inlets 212, 412 to the outlets 213, 413.

Each of the heating elements 211, 411 has two end portions 217, 417, which extend outwardly from the tubular body 21, 41 and which are provided with a pair of terminal contacts 220, 420, respectively, that are adapted to be connected electrically to a power supply (not shown). In each of the first and second heating devices 20, 40, two insulating sleeves 219, 419 are disposed respectively around the end portions 217, 417 of the respective heating element 211, 411, and are located between a respective one of the first and second end walls 21A, 21B, 41A, 41B and a respective one of the terminal contacts 220, 420.

The first pump 30 interconnects the first reservoir 10 and the first heating device 20 so as to force the cold water from the first reservoir 10 into the first heating device 20. Subsequently, the cold water flows in the first heating device 20 from the inlet 212 to the outlet 213 so as to effect a heat exchange between the cold water and the heating element 211 such that the cold water is heated to form warm water, which flows into the second reservoir 50.

The second pump 60 interconnects the second reservoir 50 and the second heating device 40 so as to force the warm water from the second reservoir 50 into the second heating device 40. Subsequently, the warm water flows in the second heating device 40 from the inlet 412 to the outlet 413 so as to effect a heat exchange between the warm water and the heating element 411 such that the warm water is heated to form hot water, which can be drawn into the water tap unit 101.

The tubular bodies 21, 41 of the first and second heating devices 20, 40 are attached to and are in thermal communication with a tubular body 11 of the first reservoir 10, thereby preheating the cold water in the first reservoir 10. In this embodiment, the tubular bodies 21, 41, 11 of the first and second heating device 20, 40 and the first reservoir 10 are made of an aluminum alloy.

The control unit 100 (see FIG. 5) is connected to the heating elements 211, 411 and the first and second pumps 30, 60.

Figure 3:
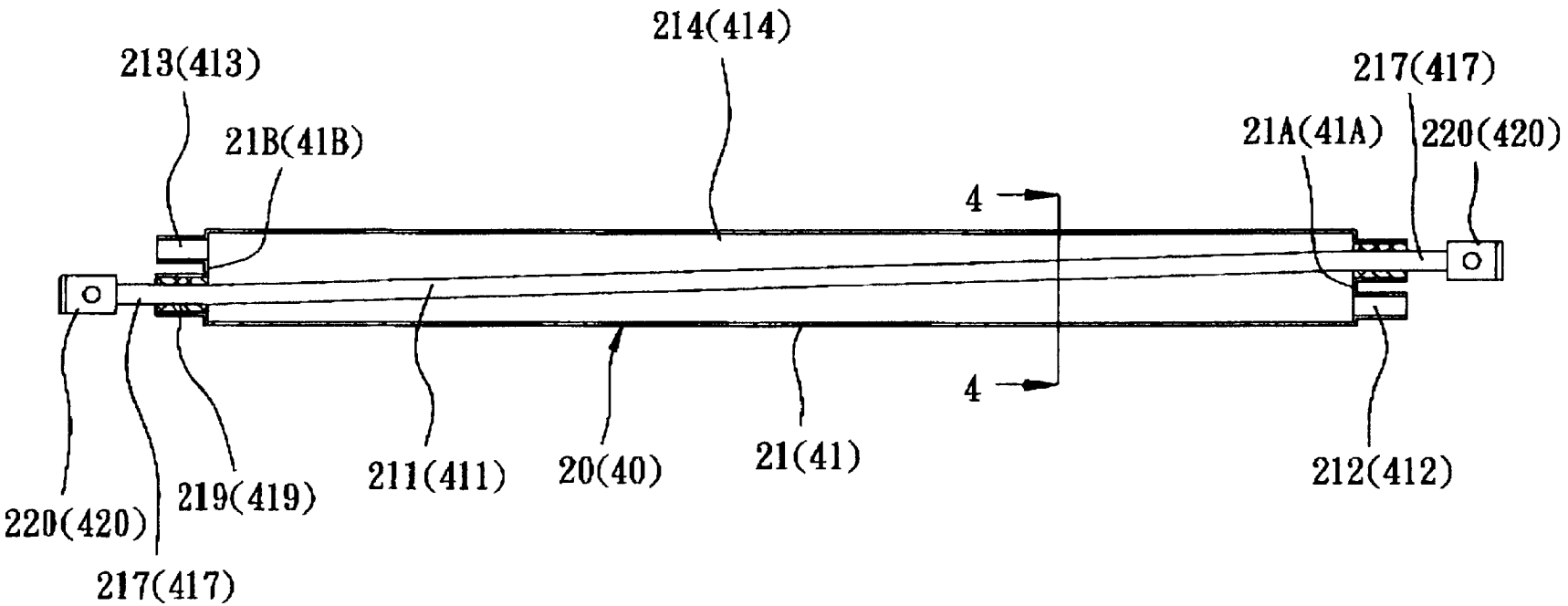
FIG. 3 is a sectional, top view illustrating the structure of each of a pair of first and second heating devices of the first preferred embodiment.
Figure 4:
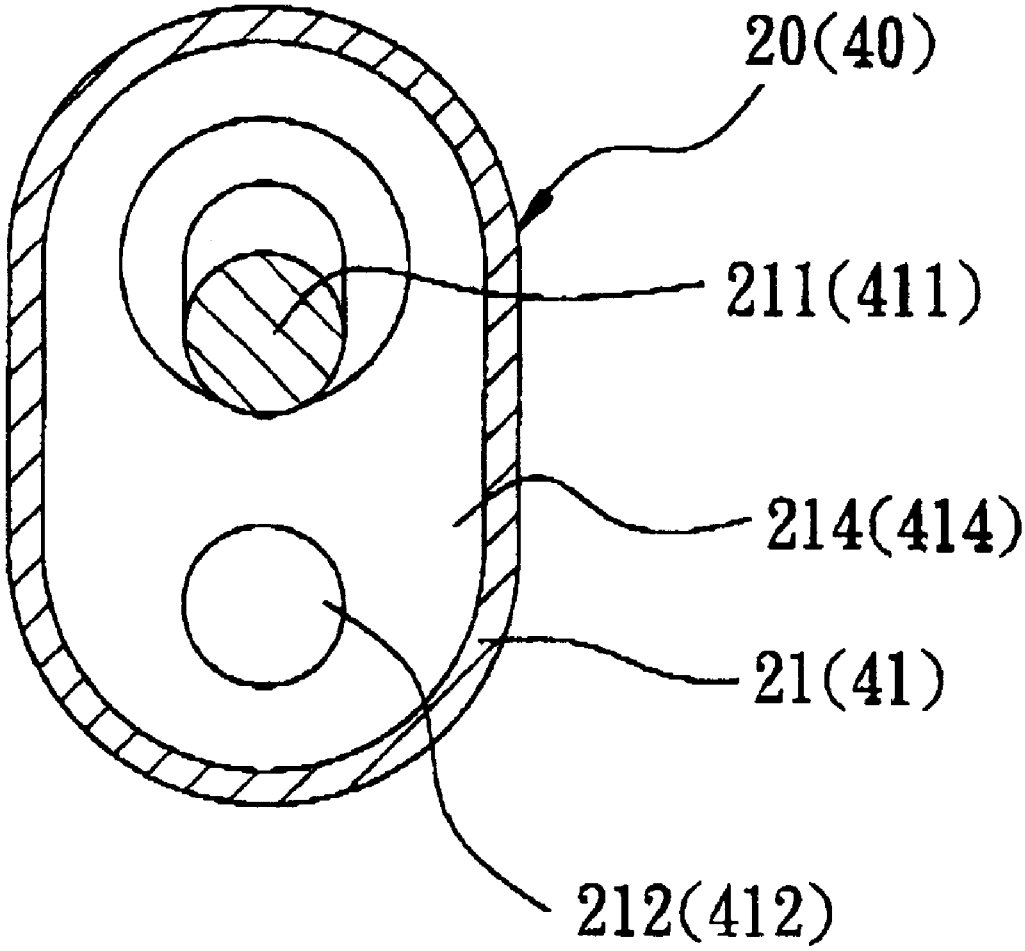
FIG. 4 is a sectional view taken along Line 4—4 in FIG. 3.
Figure 5:
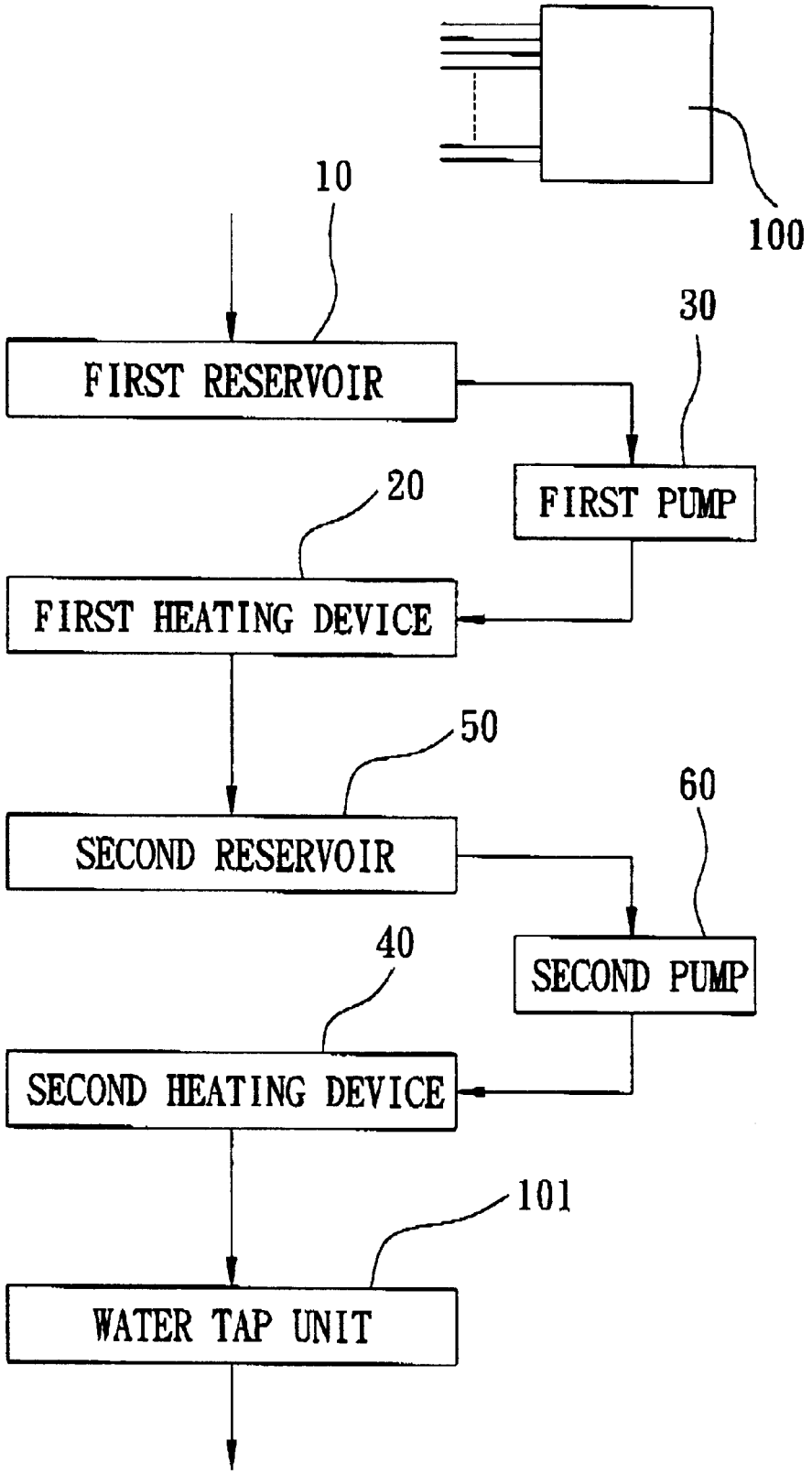
FIG. 5 is a block diagram illustrating the water heating process of the first preferred embodiment.
Figure 6:
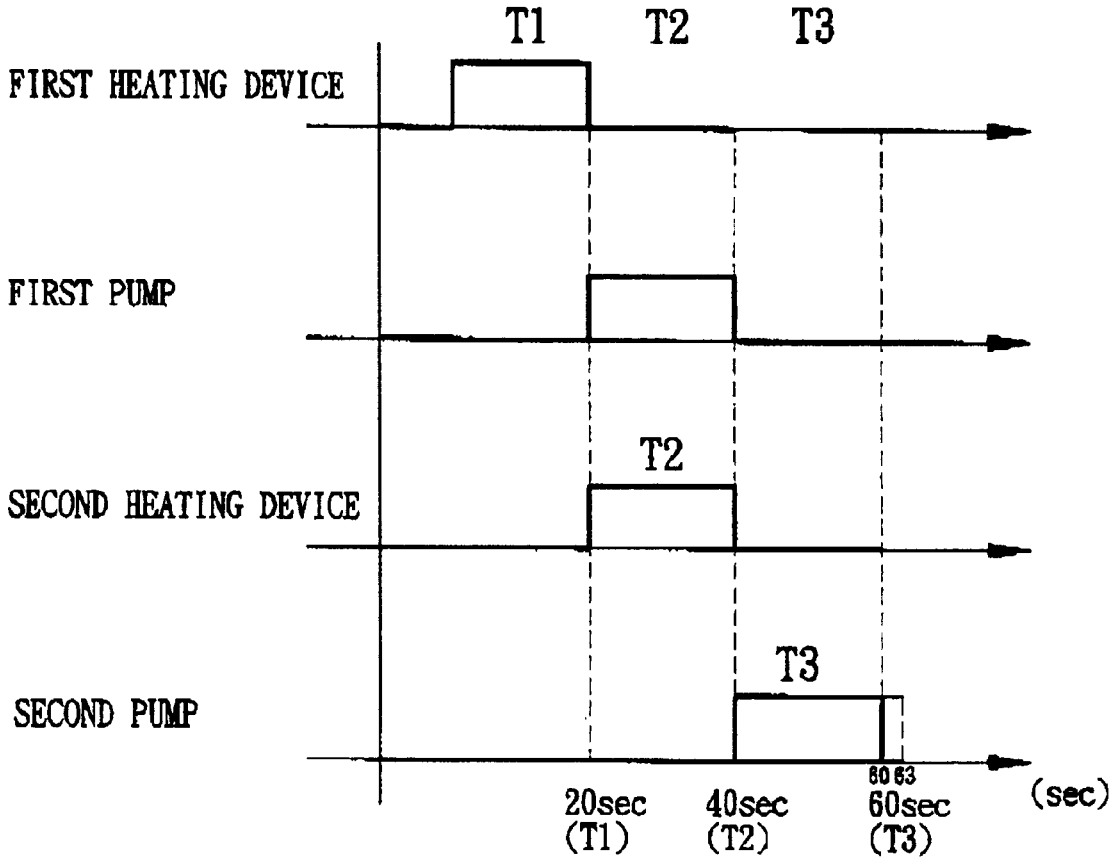
FIG. 6 is a timing diagram of the water heating process of the first preferred embodiment.

Referring to FIGS. 3, 5 and 6, a non-circulating method for heating water rapidly at low power requirement, is performed by the first preferred embodiment, under the control of the control unit 100, and includes the steps of:

(1) energizing and heating the heating element 211 of the first heating device 20 for a first period (t1) so that the temperature of the heating element 211 of the first heating device 20 rises to a first temperature;

(2) simultaneously de-energizing the heating element 211 of the first heating device 20, operating the first pump 30 in order to force the cold water, which has a temperature (T1) of about 22° C.~25° C., from the first reservoir 10 into the second reservoir 50 via the first heating device 20 so as to effect a heat exchange between the cold water and the heating element 211 of the first heating device 20 such that the cold water is heated to form the warm water, which has a temperature (T2) of about 65° C., and energizing and heating the heating element 411 of the second heating device 40 for a second period (t2) so that the temperature of the heating element 411 of the second heating device 40 rises to a second temperature that is higher than the first temperature; and (3) simultaneously de-energizing the heating element 411 of the second heating device 40 and operating the second pump 60 in order to force the warm water from the first reservoir 10 into the second heating device 40 so as to effect a heat exchange between the warm water and the heating element 411 of the second heating device 40 for a third period (t3) such that the warm water is heated to form the hot water, which has a temperature (T3) of about 95° C. and which can be drawn into the water tap unit 101.

In this embodiment, each of the first, second and third periods is about 20 seconds. In addition, it takes about 3 seconds to draw the hot water from the second heating device 40 to the water tap unit 101. As such, after tap water has been fed into the first reservoir 10, the apparatus of this invention can be actuated so as to obtain potable hot water from the water tap unit 101 within 63 seconds.

Figure 7:
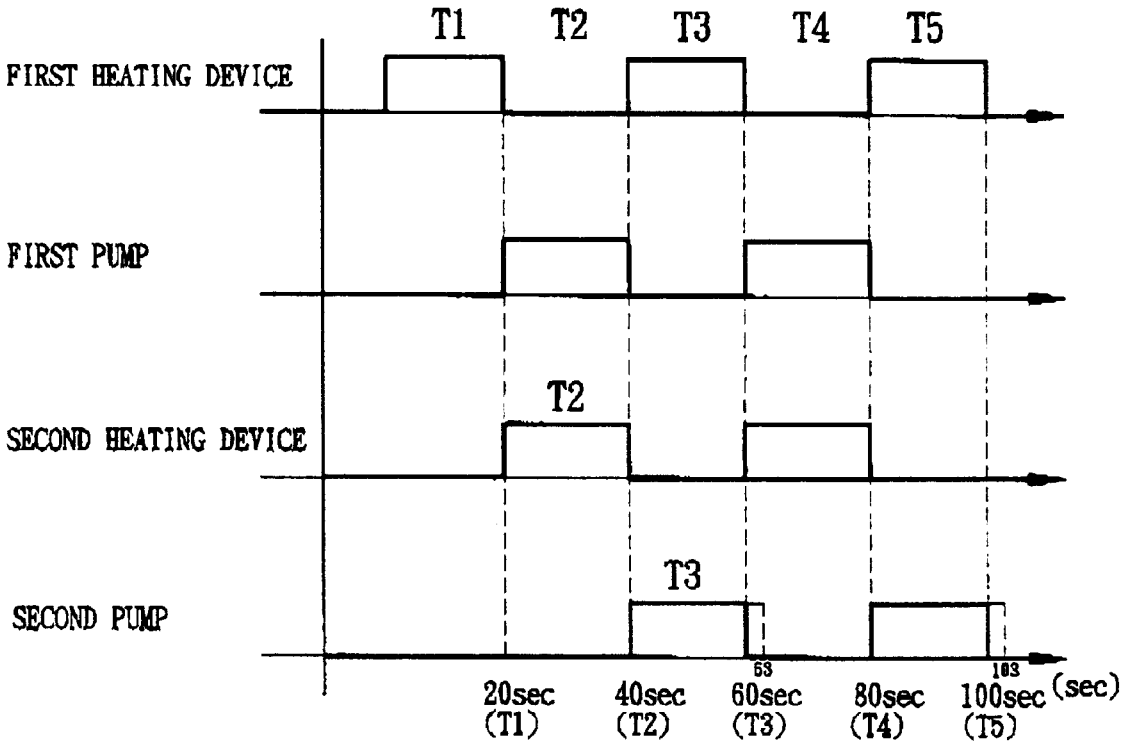
FIG. 7 is a timing diagram of a modified water heating process of the first preferred embodiment.

Referring to FIGS. 3 and 7, the step (3) of the non-circulating method can be replaced with three steps of a circulating method, which are as follows:

(1) simultaneously de-energizing the heating element 411 of the second heating device 40 and operating the second pump 60 in order to force the warm water from the second reservoir 50 into the first reservoir 10 via the second heating device 40 so as to effect a heat exchange between the warm water and the heating element 411 of the second heating device 40 for a third period (t3) such that the warm water is heated to form the hot water, which has a temperature (T3), and energizing and heating the heating element 211 of the first heating device 20 for the third period (t3) so that the temperature of the heating element 211 of the first heating device 20 rises to a third temperature that is higher than the second temperature;

(2) simultaneously de-energizing the heating element 211 of the first heating device 20, operating the first pump 30 in order to force the hot water from the first reservoir 10 into the second reservoir 50 via the first heating device 20 so as to effect a heat exchange between the hot water and the heating element 211 of the first heating device 20 such that the hot water is heated to a temperature (T4), and energizing and heating the heating element 411 of the second heating device 40 for a fourth period (t4) so that the temperature of the heating element 411 of the second heating device 40 rises to a fourth temperature that is higher than the third temperature; and (3) simultaneously de-energizing the heating element 411 of the second heating device 40 and operating the second pump 60 in order to force the warm water from the first reservoir 10 into the second heating device 40 so as to effect a heat exchange between the hot water and the heating element 411 of the second heating device 40 for a fifth period (t5) such that the temperature of the hot water is further heated to form boiled hot water, which has a fifth temperature (T5) and which can be drawn into the water tap unit 101.

Each of the first, second, third, fourth and fifth periods t1, t2, t3, t4, t5 is about 20 seconds. As such, after tap water has been fed into the first reservoir 10, the apparatus can be actuated so as to obtain the boiled hot water from the water tap unit 101 within 103 seconds.

Because only one of the first and second heating devices 20, 40 and only one of the first and second pumps 30, 60 are energized at any time during the water heating process, the power overload can be prevented, thereby avoiding fire disaster.

Figure 8:
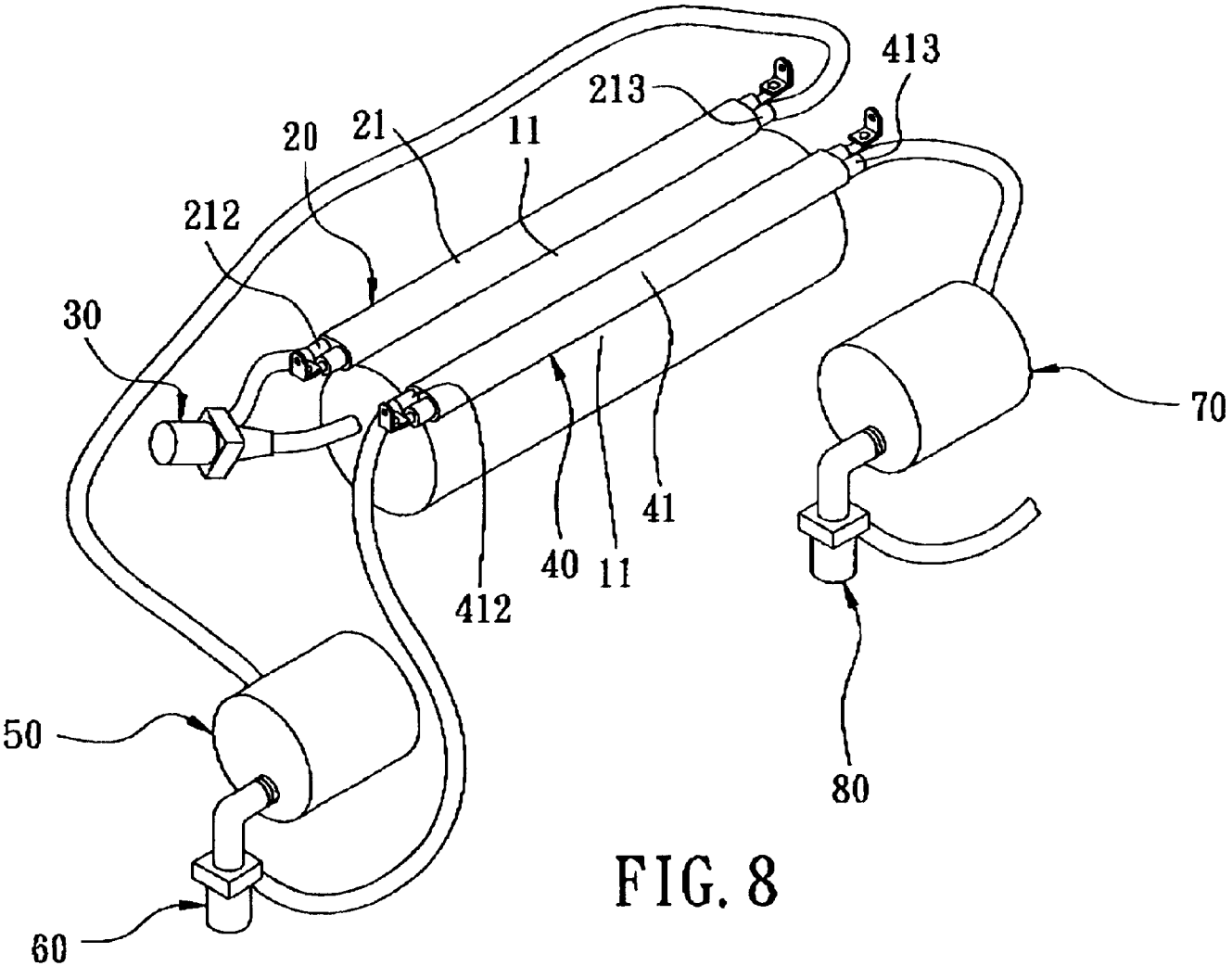
FIG. 8 is a fragmentary perspective view of a second preferred embodiment of an apparatus for heating water rapidly at low power requirement according to this invention.
Figure 9:
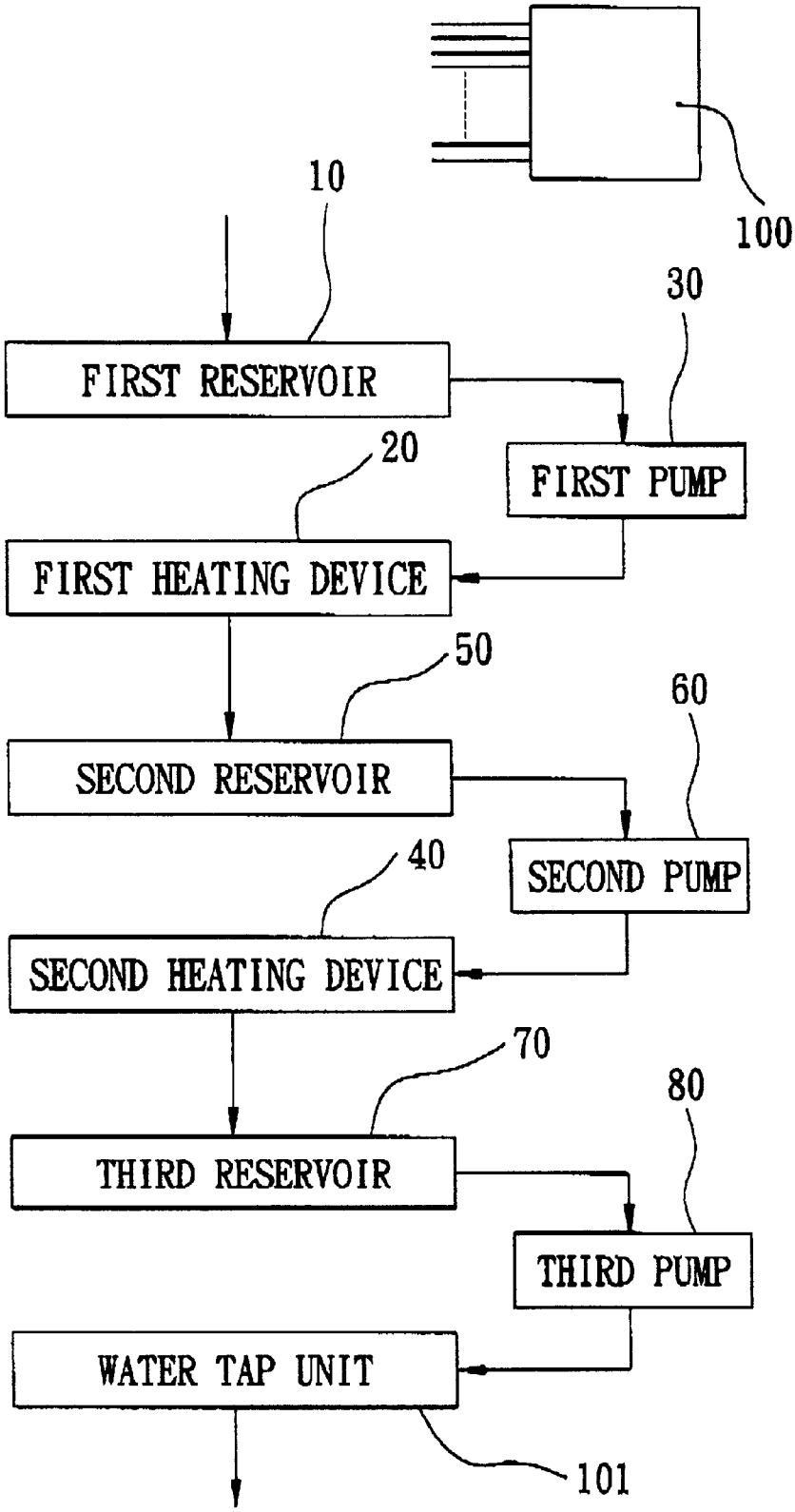
FIG. 9 is a block diagram illustrating the water heating process of the second preferred embodiment.

FIG. 8 shows a second preferred embodiment of an apparatus for heating water rapidly at low power requirement according to this invention, which is similar to the first embodiment in construction except that this embodiment further includes a third reservoir 70 and a third pump 80. The third reservoir 70 is connected to the second heating device 40, and is in fluid communication with the outlet 413 in the second heating device 40, thereby permitting flow of the hot water from the second heating device 40 into the third reservoir 70. The hot water can be drawn from the third reservoir 70 into the water tap unit (see FIG. 1) by means of the third pump 80, as shown in FIG. 9.

Figure 10:
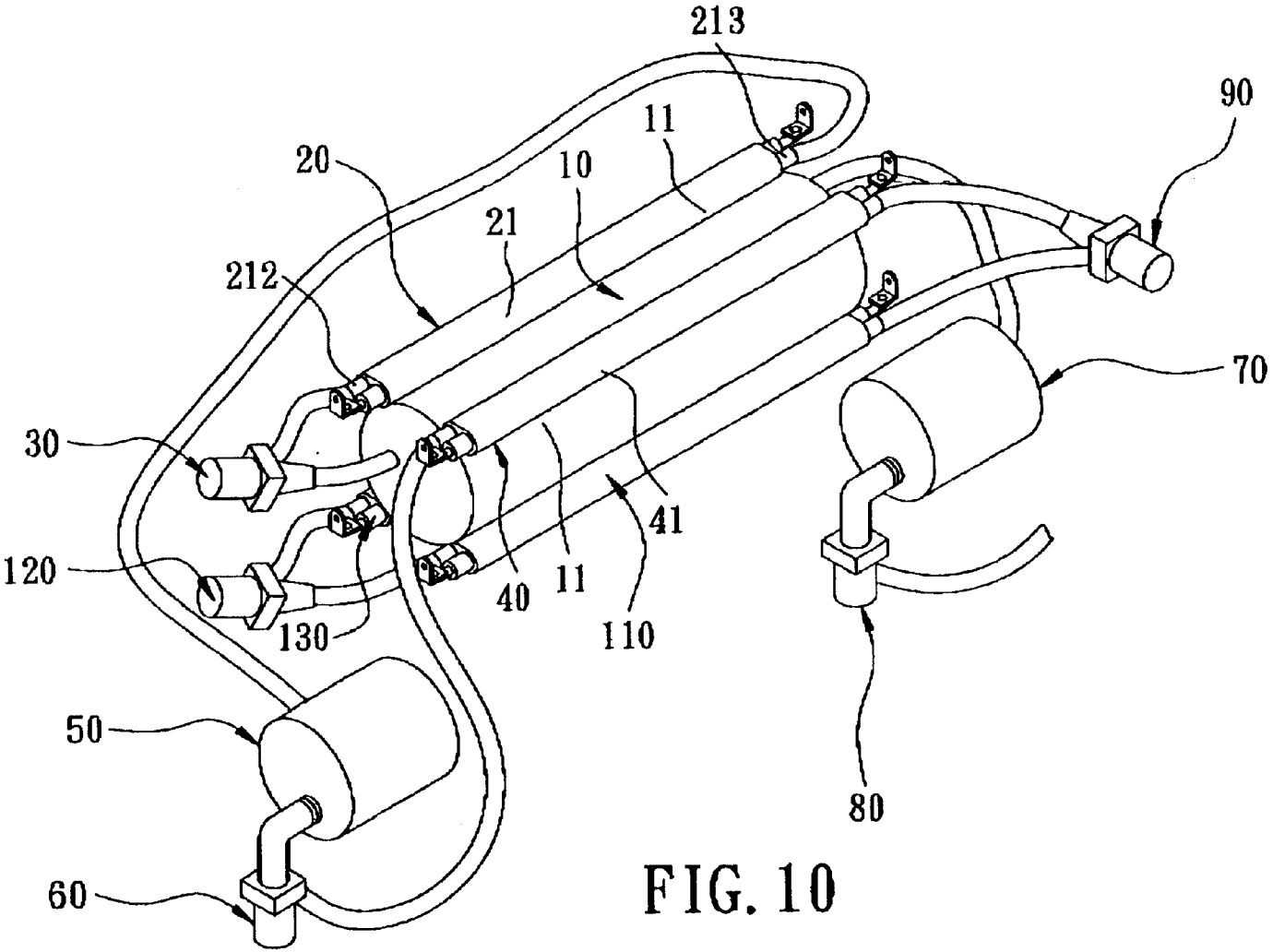
FIG. 10 is a fragmentary perspective view of a third preferred embodiment of an apparatus for heating water rapidly at low power requirement according to this invention.

FIG. 10 shows a third preferred embodiment of an apparatus for heating water rapidly at low power requirement according to this invention, which is similar to the second embodiment in construction except that this embodiment further includes a fourth pump 90, a third heating device 110, a fifth pump 120 and a fourth heating device 130. The third and fourth heating devices 110, 130 are similar to the first and second heating devices 20, 40 in construction. The fourth pump 90 interconnects the second and third heating devices 40, 110 so as to force water from the second heating device 40 into the third heating device 110. The fifth pump 120 interconnects the third heating device 110 and the fourth heating device 130 so as to force the water from the third heating device 110 into the fourth heating device 130. Unlike the previous embodiment, the third reservoir 70 is connected to and is in fluid communication with the fourth heating device 130.

Likewise, only one of the first, second, third and fourth heating devices 20, 40, 110, 130 and only one of the first, second, third and fourth pumps 30, 60, 80, 90 are energized at any time during the water heating process performed by the apparatus, thereby preventing the occurrence of a power overload.

With this invention thus explained, it is apparent that numerous modifications and variations can be made without departing from the scope and spirit of this invention. It is therefore intended that this invention be limited only as indicated by the appended claims.

I claim:

1. A method for heating water rapidly at low power requirement, said method comprising the steps of:

(1) energizing and heating a heating element of a first heating device for a first period so that temperature of said heating element of said first heating device rises to a first temperature;

(2) simultaneously de-energizing said heating element of said first heating device, operating a first pump in order to force cold water from a first reservoir into a second reservoir via said first heating device so as to effect a heat exchange between the cold water and said heating element of said first heating device such that the cold water is heated to form warm water, and energizing and heating a heating element of a second heating device for a second period so that temperature of said heating element of said second heating device rises to a second temperature that is higher than said first temperature; and (3) simultaneously de-energizing said heating element of said second heating device and operating a second pump in order to force the warm water from said second reservoir into said second heating device so as to effect a heat exchange between the warm water and said heating element of said second heating device such that the warm water is heated to form hot water.

2. The method as claimed in claim 1, wherein the step (3) includes energizing and heating said heating element of said first heating device once again at time of de-energizing said heating element of said second heating device, for a third period so that the temperature of said heating element of said first heating device rises to a third temperature that is higher than said second temperature, said method further including, after the step (3), the step of simultaneously de-energizing said heating element of said first heating device and forcing the hot water to flow through said first heating device so as to effect a heat exchange between the hot water and said heating element of said first heating device.

3. An apparatus for heating water rapidly at low power requirement, said apparatus comprising:

a first reservoir for storing cold water;

a control unit;

a first heating device connected to said first reservoir and including a tubular body that defines a chamber therein, a heating element that is fixed in said chamber in said first heating device and that is connected to said control unit, an inlet that is formed in an end of said tubular body of said first heating device and that is in fluid communication with said chamber in said first heating device and said first reservoir, and an outlet that is formed in the other end of said tubular body of said first heating device and that is in fluid communication with said chamber in said first heating device;

a second reservoir connected to said tubular body of said first heating device and being in fluid communication with said outlet in said first heating device;

a first pump, connected to said control unit, for forcing the cold water from the first reservoir into said second reservoir via said tubular body of said first heating device so as to effect a heat exchange between the cold water and the heating element of said first heating device such that the cold water is heated to form warm water, said heating element of said first heating device being energized and heated for a first period and to a first temperature just before the cold water flows into said first heating device, under control of said control unit;

a second heating device connected to said second reservoir and including a tubular body that defines a chamber therein, a heating element that is fixed in said chamber in said second heating device and that is connected to said control unit, an inlet that is formed in an end of said tubular body of said second heating device and that is in fluid communication with said chamber in said second heating device and said second reservoir, and an outlet that is formed in the other end of said tubular body of said second heating device and that is in fluid communication with said chamber in said second heating device, said heating element of said second heating device being de-energized when said heating element of said first heating device is energized, and vice versa, under the control of said control unit; and a second pump, connected to said control unit, for forcing the warm water from the second reservoir into said second heating device so as to effect a heat exchange between the warm water and the heating element of said second heating device such that the warm water is heated to form hot water, said heating element of said second heating device being energized and heated for a second period and to a second temperature, which is higher than the first temperature, just before the warm water flows into said second heating device, under the control of said control unit.

4. The apparatus as claimed in claim 3, further comprising:

a housing unit, in which said first and second reservoirs, said first and second heating devices, said first and second pumps are received; and a water tap unit disposed on said housing unit and in fluid communication with said outlet in said second heating device, whereby said apparatus serves as a household potable water dispenser.

5. The apparatus as claimed in claim 3, wherein said first reservoir has a tubular body, said tubular bodies of said first and second heating devices being attached to and being in thermal communication with said tubular body of said first reservoir, thereby preheating the cold water in said first reservoir.

6. The apparatus as claimed in claim 5, wherein said tubular bodies of said first reservoir and said first and second heating devices are made of an aluminum alloy.

7. The apparatus as claimed in claim 3, wherein said tubular body of each of said first and second heating devices is horizontal, and has an elliptical cross-section, a first end wall and a second end wall, each of said first and second end walls having a left portion and a right portion, said heating element of each of said first and second heating devices being elongated and inclined and extending through said right portion of a respective one of said first end walls and said lest portion of a respective one of said second end walls, said inlets in said tubular bodies of said first and second heating devices being formed respectively at said left portions of said first end walls, said outlets in said tubular bodies of said first and second heating devices being formed respectively at said right portions of said second end walls.

8. The apparatus as claimed in claim 7, wherein each of said heating elements of said first and second heating devices has two end portions, which extend outwardly from a respective one of said tubular bodies of said first and second heating devices and which are provided with a pair of terminal contacts, respectively, that are adapted to be connected electrically to a power supply, each of said first and second heating devices further including two insulating sleeves that are disposed respectively around said end portions of a respective one of said heating elements of said first and second heating devices and that are located between a respective one of said first and second end walls and a respective one of said terminal contacts.

* * * * *